United States Patent [19]

Lockwood et al.

[11] Patent Number: 5,025,889

[45] Date of Patent: Jun. 25, 1991

[54] ENGINE NOISE REDUCER

[75] Inventors: Alan R. Lockwood, Clarkston; Sidney C. Kolongowski, Goodrich, both of Mich.; Dilyard Doolin, Zephyr Hills, Fla.

[73] Assignee: General Motors Corporation, Detroit, Mich.

[21] Appl. No.: 398,850

[22] Filed: Aug. 25, 1989

[51] Int. Cl.[5] ..... F01N 1/02

[52] U.S. Cl. ..... 181/250; 181/273

[58] Field of Search ..... 181/206, 229, 243, 250, 181/273

[56] References Cited

U.S. PATENT DOCUMENTS

| | | | |
|---|---|---|---|
| 1,644,794 | 10/1927 | Saharoff | 181/255 |
| 2,106,482 | 1/1938 | Hargnett | 181/229 |
| 2,271,055 | 1/1942 | Wilson | 181/229 |
| 2,323,955 | 7/1943 | Wilson | 181/229 |
| 3,254,484 | 6/1966 | Kopper | 181/206 X |
| 3,323,613 | 6/1967 | Hanchett | 181/250 |
| 3,348,629 | 10/1967 | Cassel | 181/232 |
| 4,592,316 | 6/1986 | Shiratsuchi et al. | 181/229 X |
| 4,757,874 | 7/1988 | Yanagishita et al. | 181/229 |
| 4,782,912 | 11/1988 | Wandless | 181/229 |
| 4,790,864 | 12/1988 | Kostun | 181/229 X |

*Primary Examiner*—Brian W. Brown

*Attorney, Agent, or Firm*—Gordon F. Belcher

[57] ABSTRACT

A noise reducer for an engine induction system comprises an outer duct having an inlet and outlet, and an inner duct having an inlet and outlet. The inner duct has a contained portion including the inner duct outlet and a portion of the inner duct adjacent to the inner duct outlet. The contained portion is contained in the outer duct with the inner duct outlet being adjacent the outer duct outlet. The noise reducer further comprises a closure extending away from the inner duct into engagement with the outer duct. The closure is spaced apart from the inner duct outlet along the axis of the inner duct. A resonance chamber is defined by the space between the contained portion, closure and outer duct. A chamber port is defined by the space between the inner duct outlet and the outer duct. The outer duct outlet is connectable to an upstream end of the induction system so that air flows through the inner duct prior to entering the induction system and the resonance chamber communicates with the induction system enabling sound waves from the induction system to enter and exit the resonance chamber through the chamber port. The resonance chamber has a cross section and length sized so that sound waves exiting said resonance chamber destructively interfere with sound waves in the induction system to reduce noise produced by the induction system.

5 Claims, 4 Drawing Sheets

ENGINE NOISE REDUCER

TECHNICAL FIELD

This invention relates to a noise reducer for an engine induction system and, more particularly, to a noise reducer upstream of the induction system through which air flows to the induction system and which has a resonance chamber to reduce the noise from the induction system.

BACKGROUND

Engine induction systems can produce noise and are therefore sometimes equipped with noise reducers. Such noise reducers can be located upstream of the induction system and allow air to flow through them while reducing noise from the induction system. The noise reduction can be achieved through a variety of means, including specially shaped passages, placement of deflectors in passages through which sound travels, and adding chambers which trap the sound waves to dissipate the noise.

A disadvantage associated with adding chambers is that they can have obstructions which inhibit reflection of the waves entering the chamber off the interior walls of the chamber and out of the chamber. Such reflection can produce destructive interference between the sound waves exiting the chamber and the sound waves in the induction system resulting in substantial noise reduction. A disadvantage associated with specially shaping passages and adding deflectors is that such features can increase the complexity of the noise reducer making fabrication more difficult.

Noise reducers can also include additional components such as sensors and air filters. The addition of such components can reduce the compatibility of the noise reducer with different induction systems since each of the additional components must be suitable for the induction system. Including such additional components also increases the complexity of the noise reducer making fabrication more difficult.

SUMMARY OF THE INVENTION

The present invention provides a noise reducer for an engine induction system. The noise reducer comprises an outer duct having an inlet and outlet, and an inner duct having an inlet and outlet. The inner duct has a contained portion including the inner duct outlet and a portion of the inner duct adjacent to the inner duct outlet. The contained portion contained in the outer duct with the inner duct outlet being adjacent the outer duct outlet.

The noise reducer further comprises a closure extending away from the inner duct into engagement with the outer duct. The closure is spaced apart from the inner duct outlet along the axis of the inner duct. A resonance chamber is defined by the space between the contained portion, closure and outlet duct. A chamber port is defined by the space between the inner duct on the perimeter of the contained portion. The closure engages the adjacent portion of the outer duct and is spaced apart from the inner duct outlet to form a resonance chamber between the inner and outer ducts with a chamber port being formed between the inner duct outlet and the outer duct.

The outer duct outlet is connectable to an upstream end of the induction system so that air flows through the inner duct prior to entering the induction system and the resonance chamber communicates with the induction system enabling sound waves from the induction system to enter and exit the resonance chamber through the chamber port. The resonance chamber has a cross section and length sized to reduce noise produced by the induction system.

The resonance chamber and chamber port are formed with a minimal number of obstructions in them to allow sound waves to enter and exit the resonance chamber. This results in destructive interference between the sound waves exiting the resonance chamber and the sound waves in the induction system resulting in effective noise reduction. This dispenses with the need for specially shaped passages or deflectors thereby simplifying fabrication of the noise reducer. The small number of parts which comprise the noise reducer and the relative simplicity of each part also facilitates fabrication of the noise reducer.

The lack of additional components, such as sensors or air filters, in the noise reducer enables it to be incorporated in a variety of induction systems since suitability of the additional components with the induction system is not required. The lack of additional components also facilitates fabrication of the noise reducer.

These and other features and advantages of the invention will be more fully understood from the following description of certain specific embodiments of the invention taken together with the accompanying drawings.

BRIEF DRAWING DESCRIPTION

In the drawings.

Corresponding reference characters indicate corresponding parts throughout the several views of the drawings.

DETAILED DESCRIPTION

Figure 1:
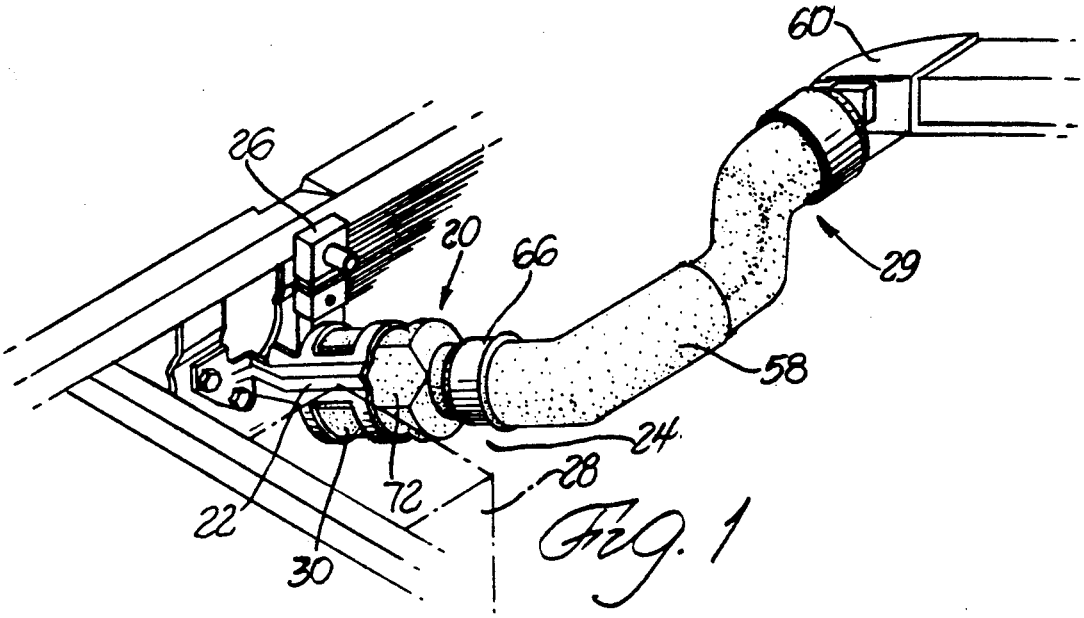
FIG. 1 is a perspective view of the engine noise reducer connected to an engine compartment and induction system.
Figure 2:
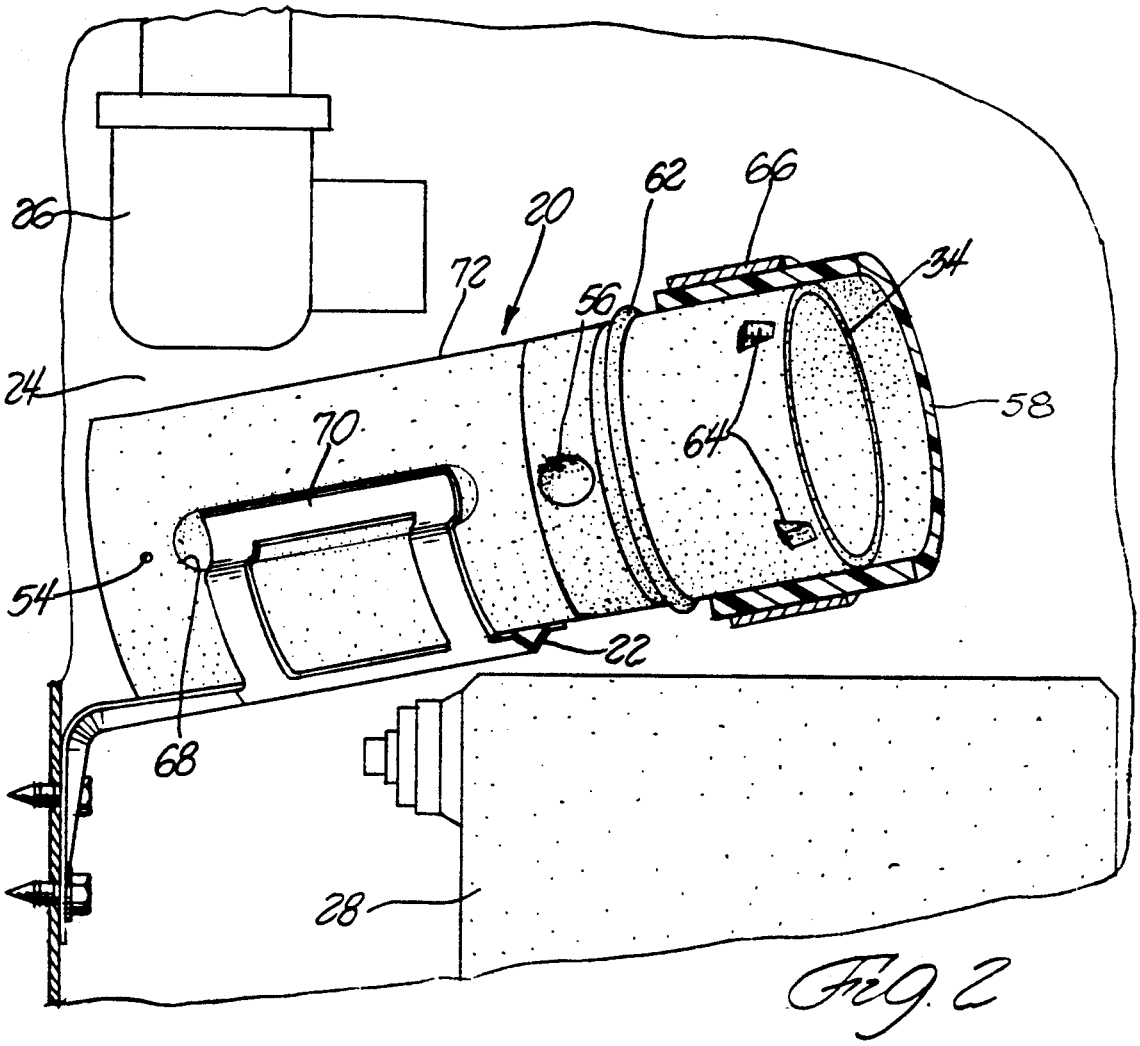
FIG. 2 is an enlarged perspective view of the engine noise reducer of FIG. 1.

Referring now to the drawings in detail, and in particular, FIGS. 1 and 2, numeral 20 generally indicates an embodiment of the noise reducer of the present invention. The noise reducer is shown held to a mounting clamp 22 which is mounted on the front of the engine compartment 24. The noise reducer 20 is held between the radiator 26 and battery 28.

Figure 3:
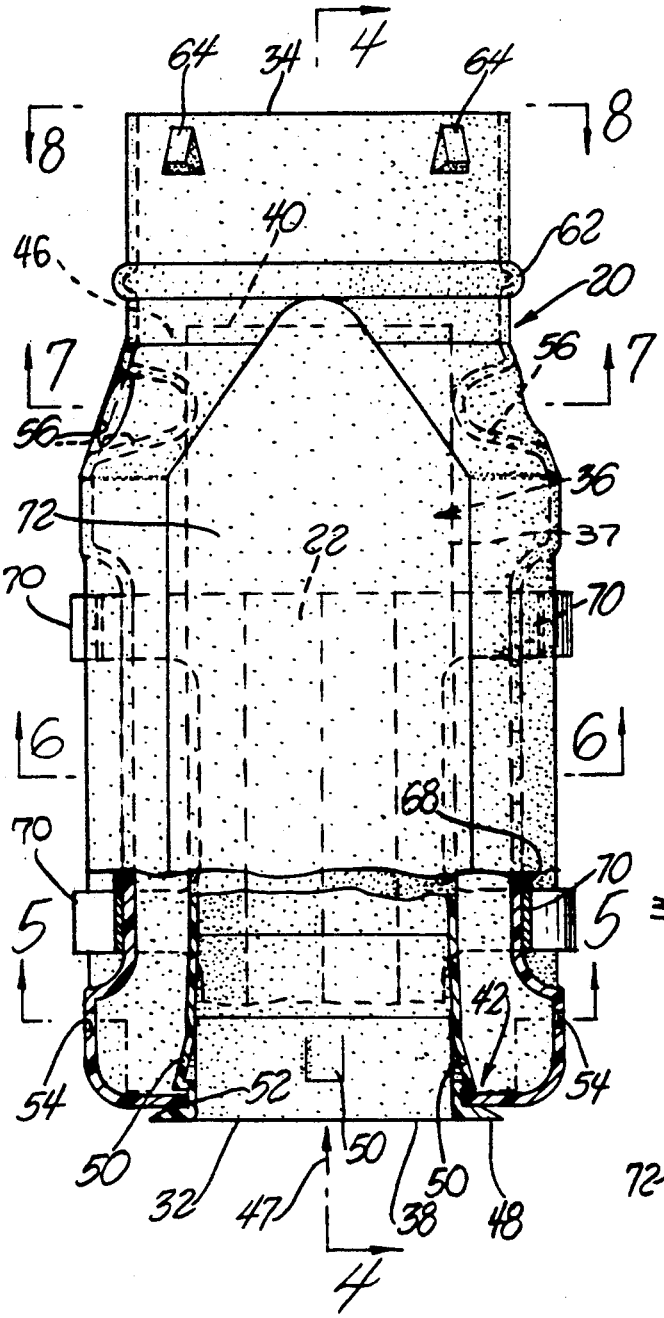
FIG. 3 is an enlarged elevational view of the engine noise reducer of FIG. 2 with portions of the outer and inner ducts broken away showing the closure.
Figure 4:
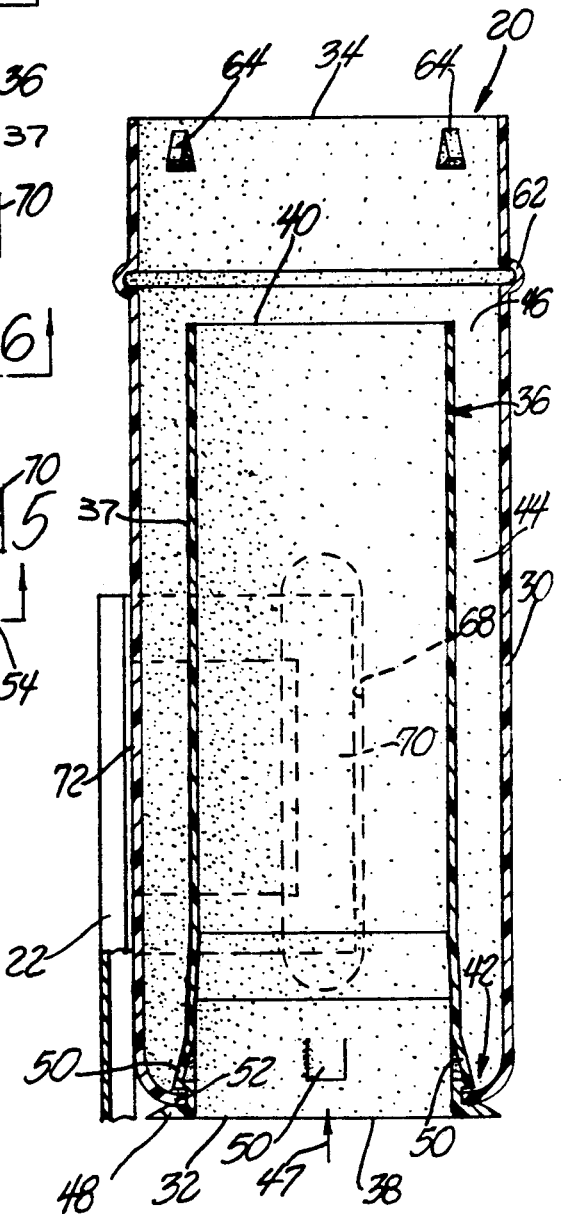
FIG. 4 is a cross sectional view generally in the plane indicated by line 4—4 of FIG. 3 showing the outer and inner ducts, and closure.

Briefly, the noise reducer 20 comprises an outer duct 30 having an inlet 32 and outlet 34, and an inner duct 36 having an inlet 38 and outlet 40, as shown in FIGS. 3 and 4. The inner duct 36 has a contained portion 37 including the inner duct outlet 40 and a portion of the inner duct adjacent to the inner duct outlet contained portion 37 is contained in the outer duct 30 with the inner duct outlet 40 being adjacent the outer duct outlet 34.

The noise reducer 20 further comprises a closure 42 extending away from the inner duct 36 into engagement with the outer duct 30. The closure 42 is spaced apart from the inner duct outlet 40 along the axis of the inner duct 36. A resonance chamber 44 is defined by the space between the contained portion 37, closure 42 and outer duct 30. A chamber port 46 is defined by the space between the inner duct outlet 40 and the outer duct 30.

The outer duct outlet 34 is connectable to an upstream end of the induction system 29 so that air flows through the inner duct 36 in the direction indicated by numeral 47 prior to entering the induction system. The resonance chamber 44 communicates with the induction system enabling sound waves from the induction system to enter and exit the resonance chamber through the chamber port 46. The resonance chamber 44 has a cross section and length sized to reduce noise produced by the induction system 29.

Figure 5:
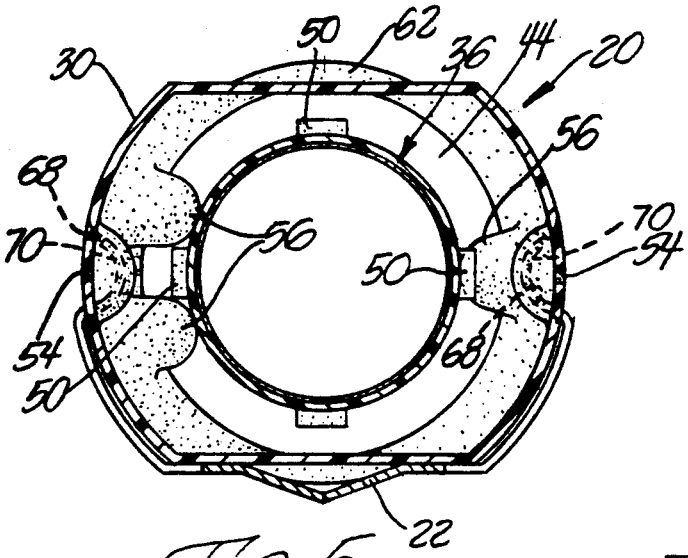
FIG. 5 is a cross sectional view generally in the plane indicated by line 5—5 of FIG. 3 showing the outer and inner ducts.
Figure 6:
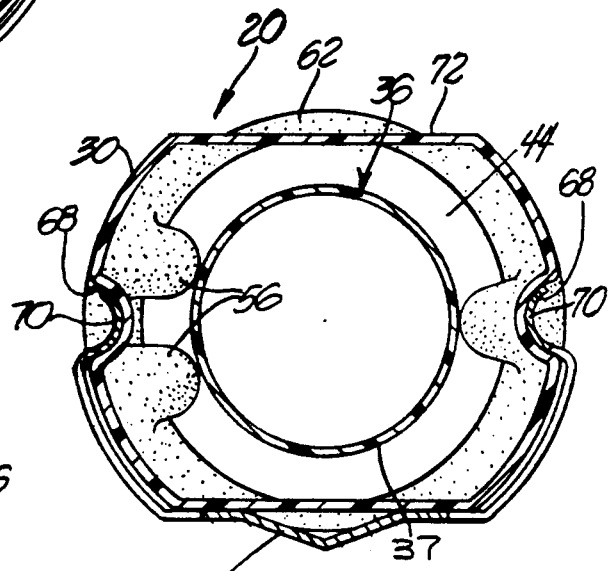
FIG. 6 is a cross sectional view generally in the plane indicated by line 6—6 of FIG. 3 showing the outer and inner ducts.
Figure 7:
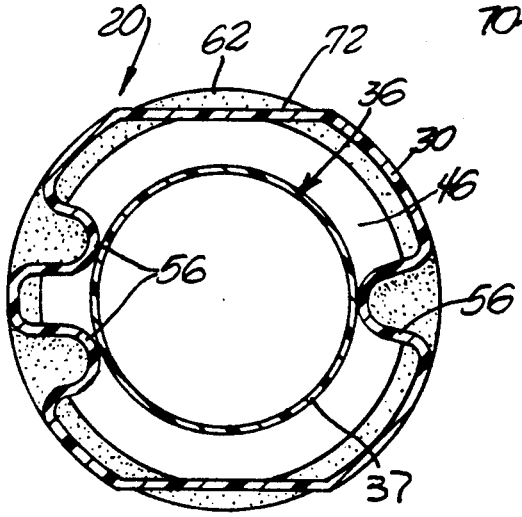
FIG. 7 is a cross sectional view generally in the plane indicated by line 7—7 of FIG. 3 showing the outer and inner ducts.
Figure 8:
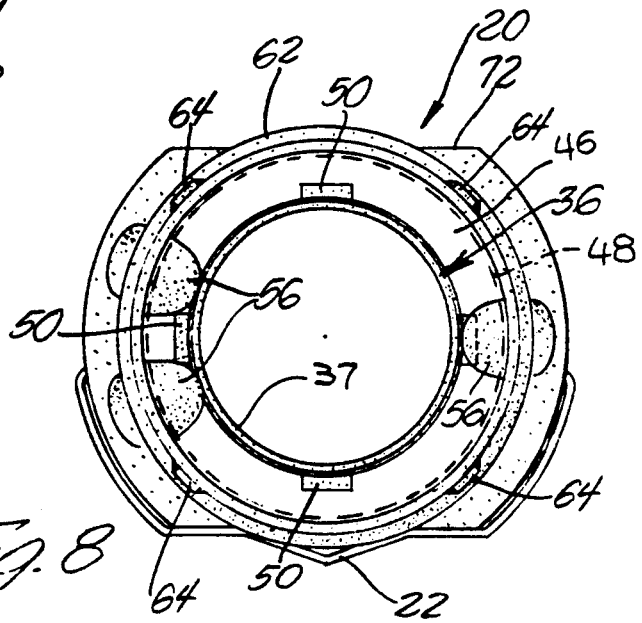
FIG. 8 is a cross sectional view generally in the plane indicated by line 8—8 of FIG. 3 showing the outer and inner ducts.
Figure 9:
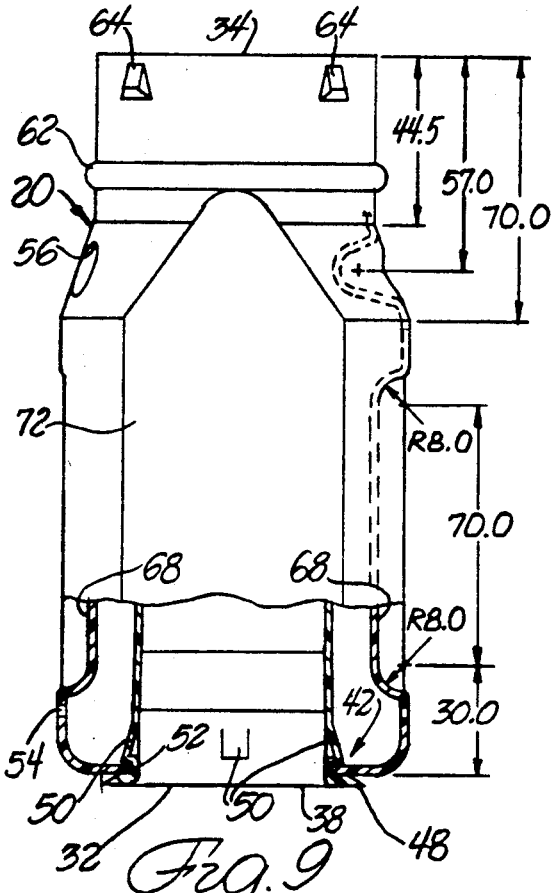
FIG. 9 is a view corresponding to FIG. 3 showing various dimensions of the outer duct of the test noise reducer.
Figure 10:
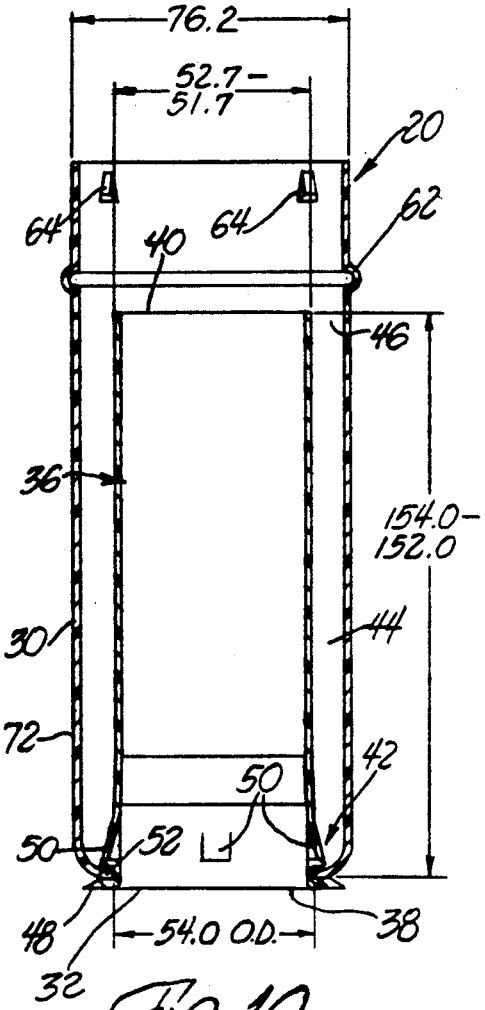
FIG. 10 is a view corresponding to FIG. 4 showing various dimensions of the outer and inner ducts of the test noise reducer.
Figure 11:
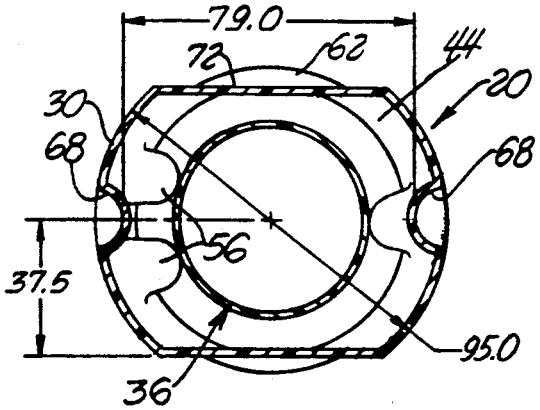
FIG. 11 is a view corresponding to FIG. 6 showing various dimensions of the outer duct of the test noise reducer.
Figure 12:
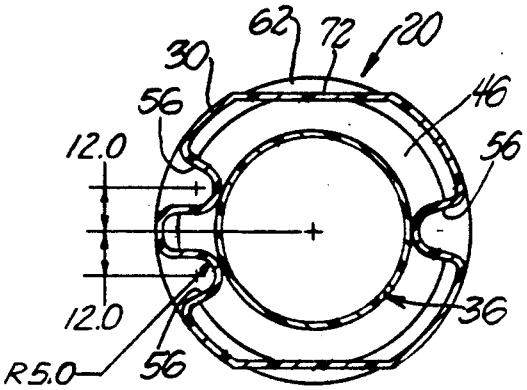
FIG. 12 is a view corresponding to FIG. 7 showing various dimensions of the outer duct of the test noise reducer.

More specifically, the inner duct 36 comprises a plastic cylindrical tube coaxially aligned in the outer duct 30, as shown in FIGS. 5–8. A part of the closure 42 is formed on the inner duct 36 adjacent its inlet 38, as shown in FIGS. 5 and 8. The remainder of the inner duct 36 has an approximately constant cross section, as shown in FIGS. 4 and 8.

The closure 42 includes a stop 48 comprising a cylindrical skirt formed on the inner duct 36 adjacent its inlet 38, as shown in FIGS. 3, 4 and 8. The closure 42 also includes four stops extending away from the inner duct 36 adjacent the skirt 48. The stops 50 are equally spaced around the circumference of the inner duct 36 and are axially spaced apart from the stop 48 along the axis of the inner duct outlet 36.

The outer duct 30 comprises a plastic cylindrical tube. As shown in FIGS. 3 and 5, the outer duct 30 has a pair of diametrically opposed radial holes 54 adjacent the outer duct inlet 32 to allow drainage of liquids that may collect in the resonance chamber 44.

The closure 42 includes a lip 52 extending radially inward from the outer duct 30 adjacent its inlet 32, as shown in FIGS. 3, 4 and 8. The lip 52 has sufficient length to engage the entire circumference of the inner duct 36 and is lodged between the stops 48, 50. The engagement of the lip 52 with the inner duct 36 forms the closed end of the resonance chamber 44. The engagement of the lip 52 with the stops 48, 50 also resists relative axial displacement between the outer and inner ducts 30, 36.

The outer duct 30 has three spacers 56 extending into the resonance chamber 44 adjacent the inner duct outlet 40, as shown in FIGS. 3 and 5–8. The spacers 56 are spaced apart from the closure 42. Each spacer 56 is formed by an inward indentation in the outer duct 30. The clearance between the ends of each spacer 56 and the inner duct 36 is very small to resist radial displacement of the inner duct with respect to the outer duct 30. This maintains the inner duct 36 in coaxial alignment in the outer duct 30. The cross section of the resonance chamber 44 is also maintained by the spacers 56.

The induction system 29 includes a hose 58 and an air cleaner 60 with the hose leading to the air cleaner 60, as shown in FIG. 1. The outer duct outlet 34 is inserted into the hose 58, as shown in FIG. 2. The outer duct 30 has a raised portion 62 around its circumference adjacent the outer duct outlet 34 to limit insertion of the outer duct into the hose 58. The outer duct 30 also has four retaining fingers 64 equally spaced around its circumference to secure the outer duct within the hose 58. A hose clamp 66 is placed around the hose 58 adjacent the raised portion 62 to further secure the hose to the outer duct 30.

The outer surface of the outer duct 30 has a pair of diametrically opposed longitudinal recesses 68. The mounting clamp 22 includes a pair of clips 70 which fit in the recesses 68 to hold the outer duct 30 in position between the radiator 26 and the battery 28, as shown in FIG. 2.

The outer surface of the outer duct 30 has diametrically opposed longitudinal flattened portions 72 midway between the recesses 68, as shown in FIGS. 3 and 5–8. As shown in FIGS. 1 and 2, the flattened portions 72 face the radiator 26 and battery 28 when the outer duct 30 is attached to the mounting clamp 22 to reduce the space required between the radiator and battery for the noise reducer 20.

In operation, the induction system 29 draws air through the inner duct 36, in the direction indicated by numeral 47, and hose 58 into the air cleaner 60. Noise produced by the induction system 29 can travel upstream out of the air cleaner 60 through the hose 58 toward the noise reducer 20. At least a portion of such sound waves enter the resonance chamber 44 through the chamber port 46. The sound waves are reflected from the inner surface of the resonance chamber 44 and exit the resonance chamber through the chamber port 46. The outer surface of the inner duct 36 and inner surface of the outer duct 30 are sized and shaped so that the resonance chamber 44 has few obstructions to the passage of the sound waves into and out of it. The resonance chamber 44 is also sized and shaped so that the sound waves reflected from its interior destructively interfere with the sound waves in the induction system 29 to reduce the noise produced by the induction system.

As a specific example, tests were conducted on a noise reducer 20 having the dimensions shown in FIGS. 9–12 with substantial noise reduction observed. All dimensions in FIGS. 9–12 are in mm. Pairs of values given for a single dimension in FIGS. 9–12 indicate a range of acceptable dimensions. The thickness of the outer duct 30 was between approximately 1.2 and 2.0 mm. The 70.0 mm and 30.0 mm dimensions shown in FIG. 9 may alternatively be approximately 47.0 mm and 29.0 mm, respectively. Also, the thickness of the outer duct may alternatively be between approximately 1.1 and 2.6 mm. No substantial effect on the noise reduction was observed during tests of noise reducers having these alternative dimensions.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property or privilege is claimed are defined as follows:

1. A noise reducer for an engine induction system comprising:

an outer duct having an inlet and outlet;

an inner duct having an inlet and outlet, said inner duct having a contained portion including said inner duct outlet and a portion of said inner duct adjacent to said inner duct outlet, said contained portion being contained in said outer duct with said inner duct outlet being adjacent said outer duct outlet; a central axis extending through the interior of said inner duct between said inner duct inlet and outlet, said central axis being symmetrical with respect to said inner duct;

a closure extending away from said inner duct into engagement with said outer duct, said closure being spaced apart from said inner duct outlet along said central axis; and a chamber port extending between said inner duct outlet and said outer duct, said chamber port being perpendicular to said central axis; and a resonance chamber being bounded by said contained portion, closure, outer duct and chamber port, said outer duct outlet being connectable to an upstream end of the induction system so that air flows through said inner duct prior to entering the induction system and said resonance chamber communicates with the induction system enabling sound waves from the induction system to enter and exit said resonance chamber through said chamber port, said chamber port being sized and said resonance chamber having a cross section and length sized so that sound waves exiting said resonance chamber destructively interfere with sound waves in the induction system to reduce noise produced by the induction system.

2. A noise reducer for an engine induction system comprising:

an outer duct having an inlet and outlet;

an inner duct having an inlet and outlet, said inner duct having a contained portion including said inner duct outlet and a portion of said inner duct adjacent to said inner duct outlet, said contained portion being contained in said outer duct with said inner duct outlet being adjacent said outer duct outlet; a central axis extending through the interior of said inner duct between said inner duct inlet and outlet, said central axis being symmetrical with respect to said inner duct;

a closure extending away from said inner duct into engagement with said outer duct, said closure being spaced apart from said inner duct outlet along said central axis; and a chamber port extending between said inner duct outlet and said outer duct, said chamber port being perpendicular to said central axis; a resonance chamber being bounded by said contained portion, closure, outer duct and chamber port, said outer duct outlet being connectable to an upstream end of the induction system so that air flows through said inner duct prior to entering the induction system and said resonance chamber communicates with the induction system enabling sound waves from the induction system to enter and exit said resonance chamber through said chamber port, said chamber port being resonance chamber having a cross section and length sized so size and said resonance sound waves exiting said resonance chamber destructively interfere with sound waves in the induction system to reduce noise produced by the induction system; and spacers extending form said outer duct into said resonance chamber, said spacers being spaced apart from said closure along said central axis to resist displacement of said inner duct toward said outer duct.

3. A noise reducer for an engine induction system comprising:

an outer duct having an inlet and outlet;

an inner duct having an inlet and outlet, said inner duct having a contained portion including said inner duct outlet and a portion of said inner duct adjacent to said inner duct outlet, said contained portion being contained in said outer duct with said inner duct outlet being adjacent said outer duct outlet; a central axis extending through the interior of said inner duct between said inner duct inlet and outlet, said central axis being symmetrical with respect to said inner duct; a chamber port extending between said inner duct outlet and said outer duct perpendicular to said central axis; and a closure comprising a pair of stops extending away from said inner duct, said stops being spaced apart from said inner duct outlet along said central axis; said stops being spaced apart from one another along said central axis, and a lip extending inward from said outer duct, said lip extending a sufficient distance to lodge between said stops so that a resonance chamber is bounded by said contained portion, closure, outer duct and chamber port, said outer duct outlet being connectable to an upstream end of the induction system so that air flows through said inner duct prior to entering the induction system and said resonance chamber communicates with the induction system enabling sound waves from the induction system to enter and exit said resonance chamber through said chamber port, said chamber port being sized and said resonance chamber having a cross section and length sized so that sound waves exiting said resonance chamber destructively interfere with sound waves in the induction system to reduce noise produced by the induction system.

4. A noise reducer for an engine induction system as set forth in claim 1 wherein said outer duct is cylindrical, said inner duct is cylindrical, said inner duct being coaxially aligned with said outer duct, and said resonance chamber and said chamber port are annular.

5. A noise reducer as set forth in claim 4 wherein said outer duct has an outer diameter of approximately 76.2 mm, said inner duct has an outer diameter between approximately 51.7 and 52.7 mm, said inner duct has a thickness between approximately 1.1 and 2.6 mm, and said contained portion has an axial length between approximately 152 and 154 mm.

* * * * *